United States Patent [19]

Heimbrock

[11] Patent Number: 4,740,177

[45] Date of Patent: Apr. 26, 1988

[54] CLUSTER ASSEMBLY WITH LOCKING TABS

[75] Inventor: Henry H. Heimbrock, Cincinnati, Ohio

[73] Assignee: Standex International Corporation, Salem, N.H.

[21] Appl. No.: 12,325

[22] Filed: Feb. 9, 1987

[51] Int. Cl.[4] ..... H01R 13/44

[52] U.S. Cl. ..... 439/596; 439/603

[58] Field of Search ..... 339/59 R, 59 M, 192 R, 339/217 S; 439/586, 596, 603, 682, 691, 689, 744, 871

[56] References Cited

U.S. PATENT DOCUMENTS

| | | | |
|---|---|---|---|
| 3,012,159 | 12/1961 | Druesedow | 310/71 |
| 3,441,661 | 4/1969 | Brummans | 174/138 |
| 3,517,370 | 6/1970 | Poingt | 339/59 |
| 3,530,424 | 9/1970 | Gregory | 339/91 |
| 3,566,341 | 2/1971 | Skony | 339/192 |
| 3,590,330 | 6/1971 | Teagno et al. | 317/101 |
| 3,644,811 | 1/1972 | Teagno et al. | 339/47 |
| 3,648,213 | 3/1972 | Kobler | 339/59 |
| 3,727,172 | 4/1973 | Clark | 339/59 |
| 3,747,047 | 7/1973 | Carter et al. | 339/59 |
| 3,763,458 | 10/1973 | Taormina et al. | 339/59 |
| 3,781,760 | 12/1973 | Mancini et al. | 339/59 |
| 3,944,312 | 3/1976 | Koenig | 339/59 |
| 3,971,613 | 7/1976 | Kobler | 339/59 |
| 3,982,805 | 9/1976 | Irie | 339/59 |
| 4,013,331 | 3/1977 | Kobler | 339/59 |
| 4,045,110 | 8/1977 | Sterken | 339/217 |
| 4,085,989 | 4/1978 | McCardell | 339/59 |
| 4,114,971 | 9/1978 | Heimbrock | 339/59 R |
| 4,124,264 | 11/1978 | Kato et al. | 339/59 |
| 4,238,140 | 12/1980 | Cairns et al. | 339/186 |
| 4,253,718 | 3/1981 | Bungo | 339/59 |
| 4,295,698 | 10/1981 | Chow | 339/59 |
| 4,358,179 | 11/1982 | Bourdon et al. | 339/217 |
| 4,602,836 | 7/1986 | Garretson et al. | 339/59 |

FOREIGN PATENT DOCUMENTS

| | | | |
|---|---|---|---|
| 809214 | 7/1951 | Fed. Rep. of Germany . | |
| 2308218 | 11/1976 | France | 339/59 R |

*Primary Examiner*—Gil Weidenfeld
*Assistant Examiner*—Paula A. Austin
*Attorney, Agent, or Firm*—Wood, Herron & Evans

[57] ABSTRACT

A cluster assembly having a block and connector clips disposed within passageways in the block. Locking tabs pivotally mounted in the block and integral therewith drop into the receptacles forming part of the clips to hold the clips within the block.

2 Claims, 1 Drawing Sheet

CLUSTER ASSEMBLY WITH LOCKING TABS

This invention relates to a cluster assembly of the type described in U.S. Pat. No. 3,566,341.

The cluster assembly has particular application in hermetically-sealed compressors for refrigeration and air-conditioning units. The hermetically-sealed compressor has a housing containing a motor and a compressor driven by the motor. Electrical connection to the motor within the interior of the housing is made through a header or glass-to-metal seal consisting of three pins mounted in insulated material, the pins passing from the inside of the housing to the outside. Three lead wires from the electrical motor must be connected to the internal pins of the glass-to-metal seal.

The lead wires have connector clips on their ends. The three connector clips are disposed in longitudinal passageways in a cluster block. The cluster block has a front wall having holes aligned with receptacles formed in the clips so that the cluster block can be applied to the header by aligning the pins with the holes in the cluster block and thrusting the cluster block home on the pins.

It is desired that the clips have a good "pull-out force," that is, have a good resistance to being pulled from the cluster block passageways in a longitudinal direction. The pull-out force is required for a variety of reasons not the least of which is the fact that assemblers will, from time to time, hold the cluster block and swing the motor and compressor unit from the lead wires dangling therefrom.

Connector clips of the type disclosed in U.S. Pat. No. 3,566,341 derive their pull-out force from a projection on the clip, the projection being supported on metal that is capable of flexing as it is thrust into the cluster block. The projection on the clip rides over a detent and drops into a hole when the clip is thrust into the cluster block. The detent, under normal stress, blocks the removal of the clip. When, however, sufficient pull-out force is applied, the projection carves its way out through the detent. The pull-out force for the clip of that patent is about 15–16 pounds.

The objective of the present invention has been to increase the pull-out force to about 40 pounds.

The objective of the invention is attained in part by providing a flexible tab within the cluster block, the tab dropping into the clip receptacle with at least about 0.025 inch interference. In accordance with the invention, it is the flexing tab as contrasted to the flexing detent that provides the retaining element. The 0.025 interference improves the pull-out resistance to about 40 pounds.

Pivoted tabs in insulated housings for connectors are well known. Usually the entire tab projects into the passage. It must be spaced from the interior wall of the housing so that it can flex toward that wall when the connector clip is introduced. To provide such tabs in a cluster block of the present invention would introduce a requirement of an undesirably great transverse dimension.

The deficiencies of the prior art have been avoided by the present invention in which the wall opposite the wall through which the header pins pass is formed with holes substantially in alignment with the holes through which the header pins pass. The tabs of the present invention, formed integrally with the block, are disposed in those holes. An interior portion of each tab projects into the cluster block passageway where it must be engaged and flexed outwardly as each clip is introduced. In flexing outwardly, each tab swings into the space permitted by the formation of the hole in the wall of the cluster block. Thus, no additional transverse dimension is required in order to accommodate the flexing tabs.

Further, the invention contemplates the use of connector clip receptacles that are open at each end. Such connector clips, when in place, will admit of the passage of a slender tool from the pin-receiving hole through the receptacle to the flexing tab. Through the use of this tool, the flexing tab can be forced out of the way of the clip so that the clip can be removed when that is desired.

The several objectives and features of the invention will become more readily apparent from the following detailed description taken in conjunction with the accompanying drawings in which.

Figure 1:
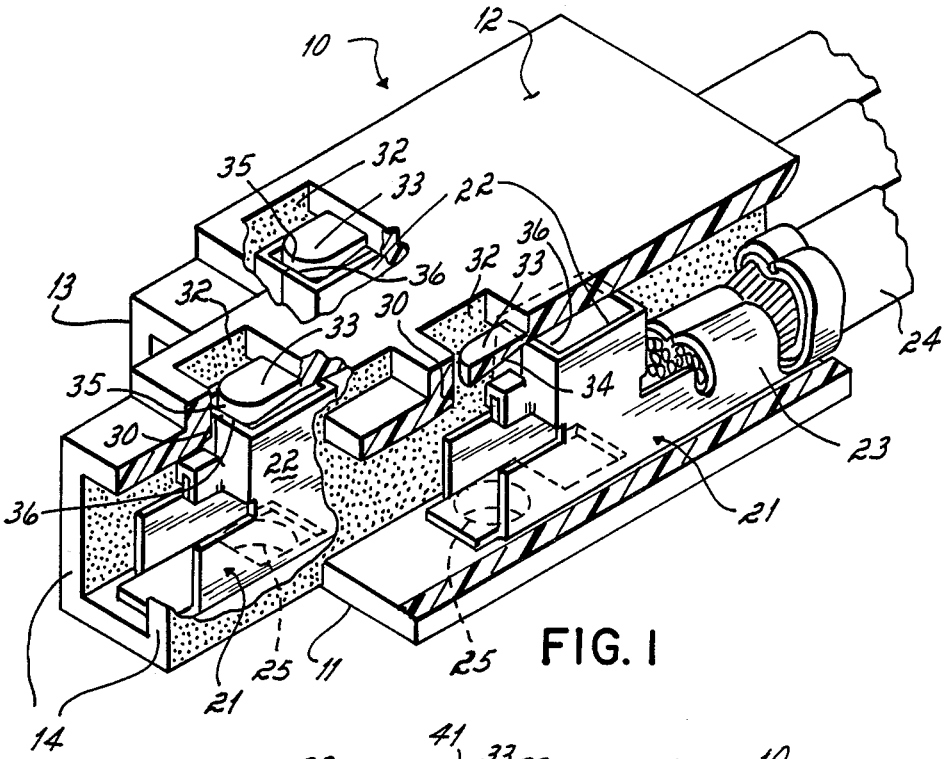
FIG. 1 is a perspective view partly in section of a cluster assembly containing a clip.

The cluster assembly 10 has a front wall 11, a back wall 12, side walls 13 and two center partitions 14. The side walls 13 and the center partitions 14 space the front and back walls apart and divide the block into three longitudinal passageways 20. Each longitudinal passageway has a clip 21 which includes a receptacle 22 through which a pin passes and a ferrule 23. The ferrule is adapted to clamp about a lead wire 24 to which the compressor motor is attached. The receptacle 22 is open at both ends.

The front wall 11 of the cluster block has three holes 25 that are equiangularly spaced apart, each hole being aligned with a respective clip receptacle 22 when the clip is in operating position in the cluster block.

The back wall 12 produces a shoulder 30 in each passageway. Each clip butts into the shoulder 30 when in place and thus the shoulder defines the desired position of the clip within the passageway so that the receptacle is in alignment with the pin-receiving hole 25. The back wall also has three equiangular holes 32 that are substantially in alignment with the pin-receiving holes 25. Each hole has a tab 33 integrally connected to the back wall 12 and cantilevered into the hole 32. The tab 33 has an internal wall 34 formed as a ramp leading to its end 35. The end of the tab engages a surface 36 on the clip and thus forms a detent to block removal of the clip. About 0.025 inch interference is provided.

Figure 2:
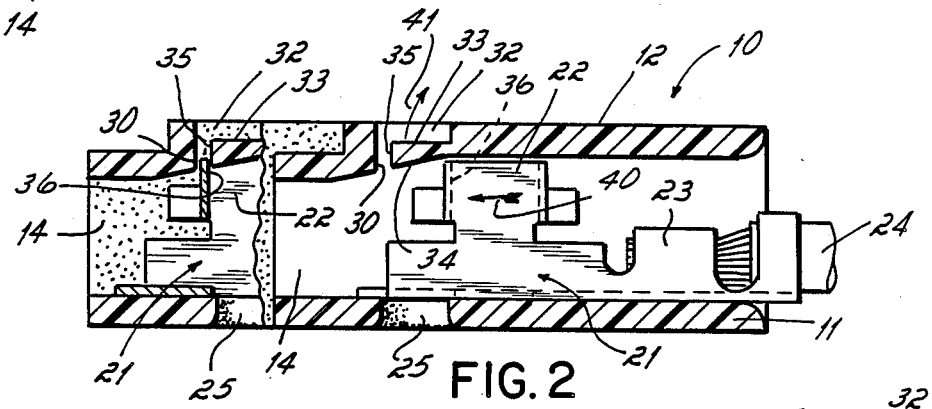
FIG. 2 is a longitudinal sectional view of the cluster assembly.
Figure 3:
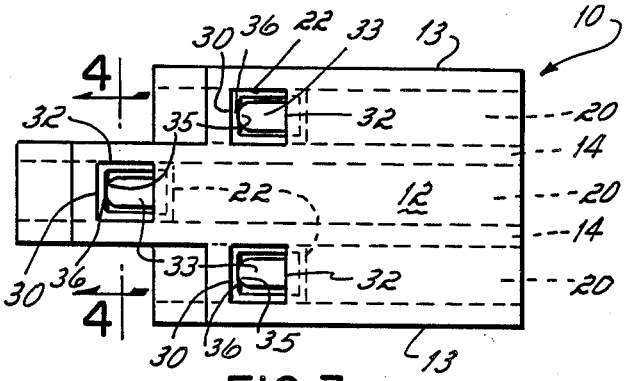
FIG. 3 is a top plan view of the cluster assembly.
Figure 4:
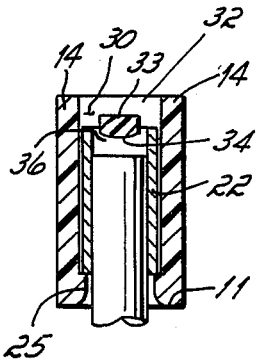
FIG. 4 is a cross-sectional view taken along lines 4—4 of FIG. 3.

In the operation of the invention, each connector clip is introduced into a respective passageway 20 in the direction of the arrow 40 from right to left as viewed in FIGS. 1, 2 and 3. The clip will engage the ramp 34 on the tab 33, thus pivoting it upwardly into the hole 32. When the surface 36 of the receptacle passes the surface 35 of the tab, the tab drops into the receptacle. In this position, the receptacle is locked between the shoulder 30 and the surface 35 of the tab. A pull-out force of about 40 pounds is required to remove a clip from the block.

If it is desired to remove the clip, a slender tool introduced through the pin-receiving opening 25 will pass through the receptacle and engage the ramp 34 of the tab 33, thereby pivoting it in the direction of the arrow 41. In this way, the clip is freed for removal in a direction opposite to the direction of the arrow 40.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

What is claimed is:

1. A cluster assembly comprising a block having a front wall, a back wall, spaced parallel inner partitions and side walls between said front and back walls creating three longitudinal passageways, said front wall having three equiangularly-spaced pin-receiving holes, each communicating with a respective passageway and a connector clip disposed in each passageway, each connector clip having a pin-receiving receptacle aligned with a respective hole in said front wall, the improvement comprising:

said back wall having three holes substantially aligned with said pin-receiving holes, a locking tab integral with said back wall and cantilevered into each said hole in said back wall, said tab projecting into its respective passageway and adapted to drop into the receptacle of a clip inserted into said passageway to block removal of said clip in one direction, said back wall having a shoulder in each passageway blocking removal of said clip in the opposite direction.

2. A cluster assembly as in claim 1 further comprising:

said clip receptacle being open at both ends, said tab being engageable by a slender tool projected through said pin-receiving hole and said receptacle to pivot said tab outwardly, thereby freeing a clip for removal.

* * * * *